US006036573A

United States Patent [19]

Huang

[11] Patent Number: 6,036,573

[45] Date of Patent: Mar. 14, 2000

[54] EXERCISING HULA HOOP WITH VOCAL SYNTHESIS AND LCD DISPLAY

[76] Inventor: Hsien-Ting Huang, 1F., No. 18, Alley 101, Lane 122, Jui-Kuang Rd., Nei-hu, Taipei, Taiwan

[21] Appl. No.: 09/136,998

[22] Filed: Aug. 20, 1998

[51] Int. Cl.[7] ..... A63H 33/02

[52] U.S. Cl. ..... 446/242; 446/28

[58] Field of Search ..... 446/28, 236, 242, 446/265, 397, 404

[56] References Cited

U.S. PATENT DOCUMENTS

| | | | |
|---|---|---|---|
| 4,006,556 | 2/1977 | Williams | 446/242 |
| 4,480,831 | 11/1984 | Muller-Deinhardt | 446/236 X |
| 4,915,666 | 4/1990 | Maleyko | 446/242 |
| 5,083,964 | 1/1992 | Arad et al. | 446/236 |
| 5,108,340 | 4/1992 | Farrow | 446/242 |
| 5,145,443 | 9/1992 | Vaisnys et al. | 446/242 |
| 5,484,316 | 1/1996 | Poirier | 446/28 |

*Primary Examiner*—John A. Ricci
*Attorney, Agent, or Firm*—Ostrolenk, Faber, Gerb & Soffen, LLP

[57] ABSTRACT

An exercising hula hoop device includes a hoop body inside which a control circuit is arranged. The control circuit has a processor having the functions of rotation counting and timing so that the number of rotations of the hula hoop and the time period of use may be calculated and stored in a memory. Output devices, including visual display and audio sound generators, are provided to display the counting and timing result from the processor. Switches or keys are also provided for the hula hoop user to select the desired mode of operation and to key in the user's body information, based upon which the processor may calculate the calories consumed in using the hula hoop device. A music playing device is also incorporated in the control circuit to play one or more pre-selected rhythms so that the hula hoop user may enjoy music during use of the hula hoop. The speed of music played may correspond to the rotational speed of the hula hoop.

25 Claims, 2 Drawing Sheets

EXERCISING HULA HOOP WITH VOCAL SYNTHESIS AND LCD DISPLAY

FIELD OF THE INVENTION

The present invention relates generally to a hula hoop and in particular to a hula hoop equipped with sound output which enhances the attraction of using the hula hoop.

BACKGROUND OF THE INVENTION

Hula hoops have been widely used for they are fit for both the young and the old and furthermore requires no additional equipment for use and takes up only very limited space. People play with hula hoops for entertainment, exercise and most likely for losing weight. Conventional hula hoops are simply a hoop to be rotated around the waist portion of the human body by the player. The player has to count the number of turns by himself or herself in order to know how many turns or how long (by using an additional timer) that he or she has played. Furthermore, since conventionally, the hula hoop is generally used only by simple rotation around the player's waist, long term playing or repeatedly playing with the hula hoop may become very boring, resulting in loss of interest in continuing to play with the hula hoop.

Besides, for those attempting to lose weight by using the hula hoop, heretofore, there is no way to indicate how much energy (how many calories) has been consumed in using the hula hoop.

Thus, it is desirable to improve the conventional hula hoop in order to overcome the problems encountered by the hula hoop users so that using the hula hoop may become a more interesting exercise.

SUMMARY OF THE INVENTION

Therefore, an object of the present invention is to provide a hula hoop in which a control circuit is incorporated which counts the turns of rotation of the hula hoop and the time period that the hula hoop has been used and provides the information of the number of turns and the amount of time in use to the user.

Another object of the present invention is to provide a hula hoop comprising a processor based circuit which, based upon the body weight and/or waistline of the player, automatically calculates and provides information of the number of calories consumed in playing the hula hoop.

A further object of the present invention is to provide a hula hoop which incorporates therein a music playing device so that a selected rhythm may be played while using the hula hoop so as to make using the hula hoop more interesting.

Yet a further object of the present invention is to provide a hula hoop comprising a control circuit therein, the control circuit comprising a turns-counting element and a timing element for providing information of the number of rotation of the hula hoop and the time period of use of the hula hoop, and also comprising a storage device to store the information so that a comparison may be made upon the next use of the hula hoop.

To achieve the above objects, in accordance with the present invention, there is provided a hula hoop comprising a hoop body inside which a control circuit is arranged. The control circuit comprises a processor having the functions of rotation-counting and timing so that the number of rotations of the hula hoop and the time period of using may be calculated and stored in a memory. Output devices, including a visual display and audio sound generator, are provided to display or vocalize the counting and timing result from the processor. Switches or keys are also provided for the hula hoop user to select the desired mode of operation and to key in the player's body information, based upon which the processor may calculate the calories consumed in using the hula hoop. A music playing device is also incorporated in the control circuit to play one or more pre-selected rhythms so that the hula hoop player may enjoy music while using the hula hoop. The speed of the music played may correspond to the rotational speed of the hula hoop.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
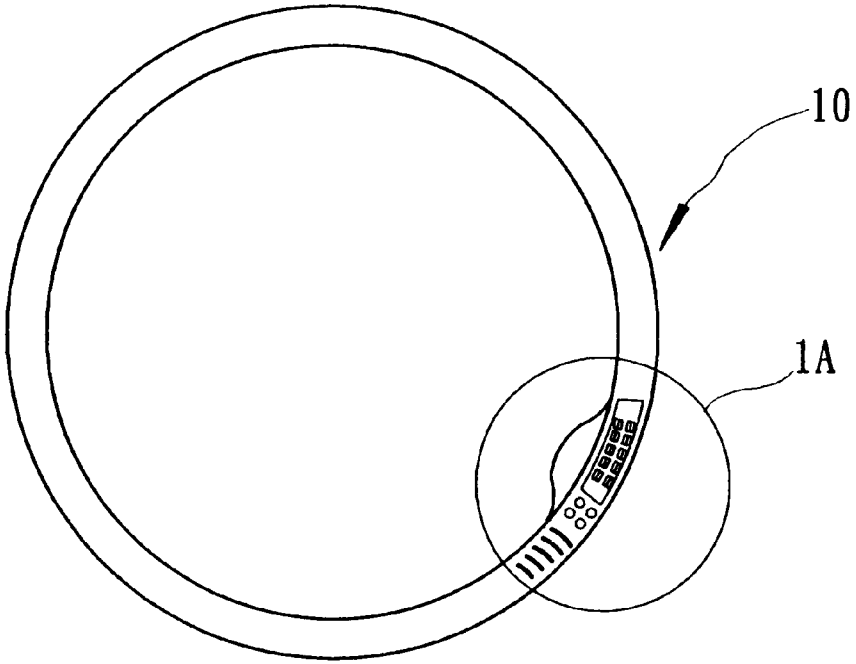
FIG. 1 is a plan view showing a hula hoop constructed in accordance with the present invention.
Figure 1A:
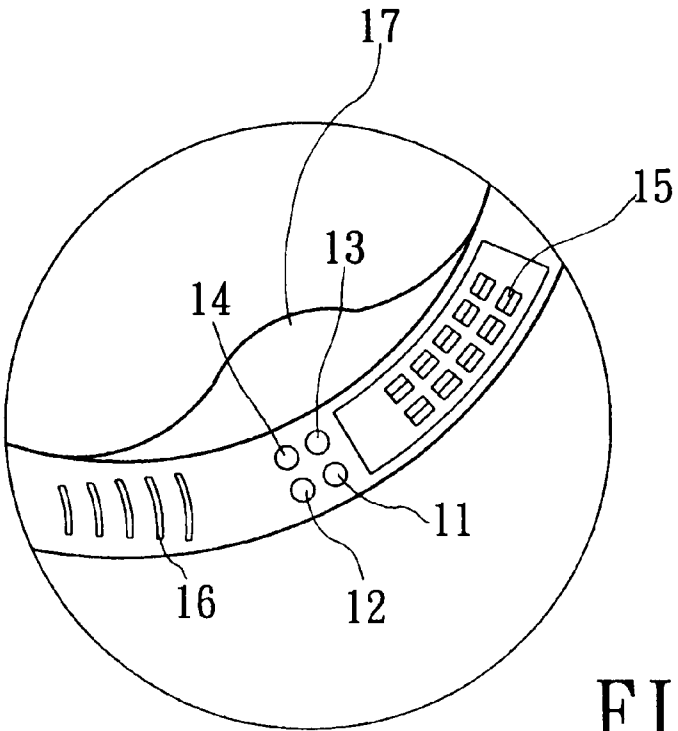
FIG. 1A is an enlarged view of the circled portion 1A of FIG. 1.
Figure 2:
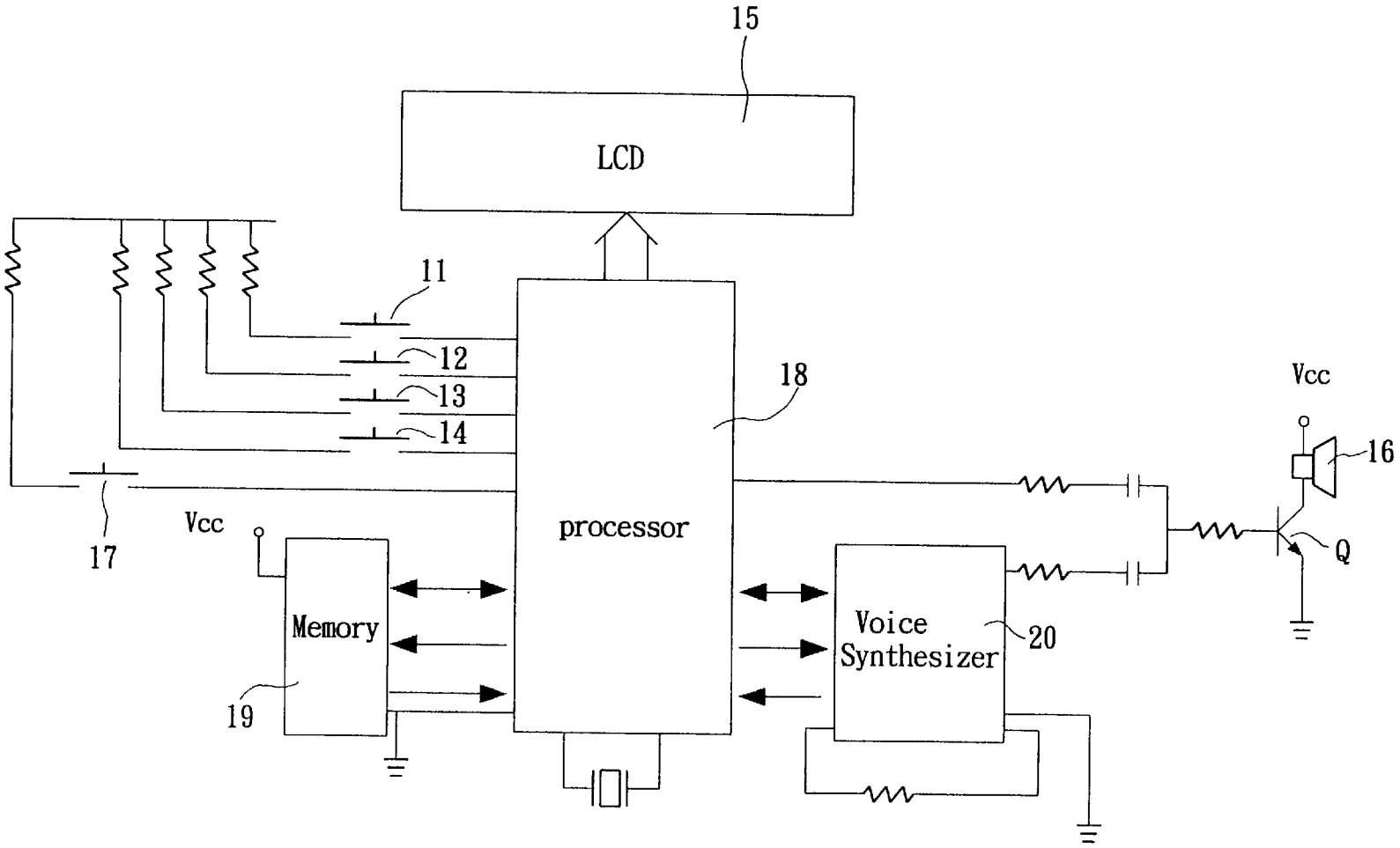
FIG. 2 is a circuit diagram showing the control circuit incorporated in the hula hoop of the present invention.

With reference to the drawings and in particular to FIG. 1, wherein a hula hoop constructed in accordance with the present invention, and is generally designated at 10, the hula hoop 10 of the present invention comprises a hoop body in which a control circuit (see FIG. 3) is embedded and controlled by a plurality of user accessible switches 11–14 which are mounted on the outside surface of the hoop body. The hula hoop 10 also comprises a visual display 15 which may comprise a liquid crystal display (LCD) and an audio signal generator, such as a speaker 16. A triggering switch, such as a micro-switch 17, is mounted on the hula hoop 10 at an inner side of the hoop body so that each time the hula hoop 10 is rotated a full turn around the user's body (not shown), the micro-switch 17 is triggered once and a signal, such as a pulse, is generated.

The switches 11–14 are for the user's control of the hula hoop control circuit so that the control circuit may selectively operate in accordance with any one of a plurality of operation schemes that are set up by means of the switches 11–14 which serves as the user or player input device. For example, the switches 11–14 may include:

(1) a mode switch 11 which allows the hula hoop user to select one operation mode from among a plurality of pre-determined modes, including regular mode, body weight mode, waistline mode, maximum number of turns mode, longest time mode and music mode, wherein in accordance with the present invention, the mode switch 11 is actuated in a cyclic fashion so that by repeatedly actuating the switch 11, the operation modes may be cyclically selected;

(2) an up-counting or increment switch 12, which provides an increment counting operation;

(3) a down-counting/clear or decrement/reset switch 13 which provides a decrement counting operation and a clear or reset operation; and (4) speaker switch 14 which controls the ON/OFF state of the speaker 16 so that the player may selectively turn off the speaker.

The control circuit comprises a processor 18 which receives signals, such as pulses, from the micro-switch 17 for counting the number of turns of rotations of the hula hoop 10 and control signals from the switches 11–14, which as mentioned above serve as player input means, to set the operation scheme for controlling the output signal supplied to the display 15 and the speaker 16. A memory 19 is connected to the processor 18 for storage of information from the processor 18. A voice synthesizing circuit 20 is connected to and controlled by the processor 18 to supply a predetermined synthesized voice signal to the speaker 16 which is in connection with and controlled by the processor 18 in order to tell the user the number of rotation that has been completed.

In operation, the player may select the desired operation mode by means of the mode switch 11 of the player input means. For example, when the regular mode is selected, each rotation of the hula hoop 10 triggers the micro-switch 17 once which supplies the signal to the processor 18, whereupon the processor 18 counts the turns. The number of turns that is counted by the processor 18 is displayed on the display 15 which is connected with and controlled by the processor 18. The processor 18 also stores the number in the memory 19 as a comparison reference for the next time the hula hoop 10 is used. With such a design, the player may know if he or she is improving his or her skill of using the hula hoop 10.

The processor 18 also functions as or incorporates therein a timer so that when the micro-switch 17 is triggered for the first time, the processor 18 measures the time period that the hula hoop 10 has been used.

The player may use the mode switch 11 to display the longest time or the maximum number of turns that one has achieved in using the hula hoop 10 by repeatedly triggering the mode switch 11 to select the longest time and/or the maximum number of turns that are stored in the memory 19. The processor 18, once entering the longest time mode or the maximum number of turns mode, automatically retrieves the information from the memory 19 and displays the information on the display 15.

In another aspect of the present invention, the processor 18 may be programmed to broadcast a predetermined audio signal through the speaker when the number of turns reaches a predetermined number, such as 50 turns, 100 turns and so on. With such an arrangement in which the speaker 16 and/or the voice synthesizer 20 constitute an audio signal generator, the user may be easily made aware of the number of turns that one has accomplished without observing the display 15. If desired, the broadcast of the number of turns may be provided more frequently in a similar manner with a synthetic voice announcing the current number of turns.

It should be noted that in any case when an audio signal is to be generated through the speaker 16, the signal may be processed by an amplification circuit Q first in order to obtain a desired level of the output audio signal.

By selecting the user body weight mode or the waistline mode, the user may enter his or her body weight or waistline by using the increment switch 12 and/or the decrement/clear switch 13. In the user body weight mode or the user waistline mode, the processor 18, serving as or incorporating therein calorie calculation means, may calculate the user's body energy (for example, in terms of calories) consumed in using the hula hoop 10 based on the body weight or waistline entered by the player through the user input device whereupon such information may be similarly announce through the speaker 16 or the display 15.

The decrement/reset switch 13 also provides the function of resetting the control circuit or clearing the previous information so that the counting and calculating operation may be performed on a new basis upon the start of the next play.

In a further aspect of the present invention, the music mode allows the processor 18 which is serving as or incorporating therein music playing means, to play one or more pre-selected rhythms, while the synthetic voice output adapted in the regular mode is suppressed. When the micro-switch 17 is triggered for the first time, the processor 18 plays 10 the selected music through the speaker 16. If desired, the speed of the music that is being played may be set to be substantially corresponding to the rotational speed of the hula hoop 10. In other words, the faster the hula hoop 10 is rotated, the more quickly the music is played.

With the hula hoop so designed, the user of the hula hoop may be made aware if he or she is performing better than before by accessing the information (such as the number of turns and the time period that he or she used the hula hoop) stored in the memory 19 through the processor 18. The energy (calories) consumed in using the hula hoop 10 may also be outputted which is particularly good for those intending to lose weight by using the hula hoop for exercise. The music mode provides the player with better entertainment in using the hula hoop and may make using the hula hoop less boring.

Although the preferred embodiment has been described to illustrate the present invention, it is apparent that changes and modifications in the specifically described embodiment can be carried out without departing from the scope of the present invention which is intended to be limited only by the appended claims.

What is claimed is:

1. An exercising hula hoop, comprising:

a hoop body; and a control circuit including a timer mounted inside the hoop body for calculating a time period of use of the hula hoop, and a triggering switch mounted on an exterior surface of the hoop body at an inner circumference thereof and in electrical connection with the timer, the triggering switch being triggered each time the hula hoop is turned a full rotation around a user's body, wherein the timer is activated to measure the time period of use a first time the triggering switch is triggered in each use session, and wherein the timer continues to calculate the time period of use upon repeated triggering of the triggering switch.

2. The hula hoop as claimed in claim 1, wherein the control circuit further includes a visual display electrically connected to and controlled by the timer to display the calculated time period of use of the hula hoop.

3. The hula hoop structure as claimed in claim 2 wherein the visual display comprises a liquid crystal display mounted on the surface of the hoop body.

4. The hula hoop as claimed in claim 1, wherein the control circuit further includes an audio signal generator electrically connected to and controlled by the control circuit, the audio signal generator including a speaker mounted in the hoop body and a voice synthesizer connected between the speaker and the timer, for vocally announcing the calculated time period of use of the hula hoop.

5. The hula hoop as claimed in claim 4, wherein the voice synthesizer is capable of announcing the time period of use at predetermined intervals during use of the hula hoop.

6. The hula hoop as claimed in claim 1, wherein the control circuit further includes a memory device to store a final measurement of the time period of use at least until a next use of the hula hoop.

7. The hula hoop structure as claimed in claim 6, wherein the control circuit further includes a visual display to display the stored information.

8. An exercising hula hoop, comprising:

a hoop body; and a control circuit including user input elements by which a user inputs user body information, a calorie consumption counter for calculating a number of calories consumed during a use session of the hula hoop on the basis of the body information inputted by the user, and a triggering switch mounted on an exterior surface of the hoop body at an inner circumference thereof and in electrical connection with the calorie consumption counter, the triggering switch being triggered each time the hula hoop is turned a full rotation around a user's body, wherein the calorie consumption counter continuously calculates the number of calories consumed in response to repeated triggering of the triggering switch.

9. The hula hoop as claimed in claim 8, wherein the user body information to be inputted is selected from the group consisting of body weight and waistline size.

10. The hula hoop as claimed in claim 8, wherein the control circuit further includes a display unit to display the calculated number of calories consumed during use of the hula hoop.

11. The hula hoop as claimed in claim 10, wherein the display unit comprises a liquid crystal display mounted on the surface of the hoop body.

12. The hula hoop as claimed in claim 8, wherein the user input elements include at least an increment switch which allows the user to increase a number input to the control circuit and a decrement switch which allows the user to decrease the number input to the control circuit.

13. An exercising hula hoop, comprising:

a hoop body; and a control circuit including a processor mounted inside the hoop body, a triggering switch mounted on an exterior surface of the hoop body at an inner circumference thereof and in electrical connection with the processor, the triggering switch being triggered each time the hula hoop is turned a full rotation around a user's body so as to send an electrical signal to the processor for calculating information during use of the hula hoop, and a liquid crystal display (LCD) mounted on the surface of the surface of the hoop body for displaying the information calculated by the processor.

14. The hula hoop as claimed in claim 13, wherein the processor is a rotation counter for counting the number of rotations of the hula hoop achieved during use thereof.

15. The hula hoop as claimed in claim 14, wherein the control circuit further includes a memory circuit for storing, at least until a next use of the hula hoop, a final number of rotations accomplished during use of the hula hoop, wherein the stored number can be recalled to be displayed on the LCD.

16. The hula hoop as claimed in claim 13, wherein the processor is a timer for measuring a time period of use of the hula hoop.

17. The hula hoop as claimed in claim 16, wherein the control circuit further includes a memory circuit for storing, at least until a next use of the hula hoop, a final measurement of the time period of use of the hula hoop, wherein the stored number can be recalled to be displayed on the LCD.

18. The hula hoop as claimed in claim 13, wherein the processor includes user information input means for inputting user information, and a calorie consumption counter for calculating a number of calories consumed during use of the hula hoop based on the information input by the user.

19. The hula hoop as claimed in claim 13, wherein the control circuit further includes an audio generator which includes a speaker mounted in the hoop body and a voice synthesizer connected between the processor and the speaker for vocally announcing the information calculated by the processor.

20. The hula hoop as claimed in claim 19, wherein the audio generator outputs the information calculated by the processor at predetermined intervals during use of the hula hoop.

21. An exercising hula hoop, comprising:

a hoop body; and a control circuit including a processor mounted inside the hoop body, a triggering switch mounted on an exterior surface of the hoop body at an inner circumference thereof and in electrical connection with the processor, the triggering switch being triggered each time the hula hoop is turned a full rotation around a user's body so as to send an electrical signal to the processor for calculating information during use of the hula hoop, and an audio generator which includes a speaker mounted in the hoop body and a voice synthesizer connected between the processor and the speaker for vocally announcing the information calculated by the processor.

22. The hula hoop as claimed in claim 21, wherein the audio generator outputs the information calculated by the processor at predetermined intervals during use of the hula hoop.

23. The hula hoop as claimed in claim 22, wherein the processor is a rotation counter for counting the number of rotations of the hula hoop achieved during use thereof.

24. The hula hoop as claimed in claim 22, wherein the processor is a timer for measuring a time period of use of the hula hoop.

25. The hula hoop as claimed in claim 21, wherein the processor includes user information input means for inputting user information, and a calorie consumption counter for calculating a number of calories consumed during use of the hula hoop based on the information input by the user.

* * * * *